United States Patent [19]

Lassiter et al.

[11] Patent Number: 4,586,323

[45] Date of Patent: May 6, 1986

[54] NOISE CONTROL SYSTEM FOR TEXTILE MACHINERY

[75] Inventors: B. Dean Lassiter, Greensboro; Vernon T. Daniel, Oak Ridge; John H. Sumner, Greensboro, all of N.C.

[73] Assignee: Burlington Ind., Inc.

[21] Appl. No.: 679,284

[22] Filed: Dec. 7, 1984

[51] Int. Cl.[4] ..... D01H 1/00; D01H 5/28; D01H 15/00

[52] U.S. Cl. ..... 57/1 R; 57/22; 57/261; 57/328; 57/350; 181/200

[58] Field of Search ..... 57/1 R, 22, 328, 333, 57/261, 350; 242/35.5 R; 28/271-276; 181/198, 200, 205, 212, 230

[56] References Cited

U.S. PATENT DOCUMENTS

| | | | |
|---|---|---|---|
| 3,713,509 | 1/1973 | Carroll | 57/1 R X |
| 3,782,087 | 1/1974 | Franzen et al. | 57/1 R |
| 3,977,169 | 8/1976 | Suzuki et al. | 57/1 R |
| 4,024,698 | 5/1977 | Weiss et al. | 57/1 R X |
| 4,031,690 | 6/1977 | Thomas et al. | 57/1 R |
| 4,043,008 | 8/1977 | Weiss et al. | 28/271 |
| 4,107,911 | 8/1978 | Yamana et al. | 57/333 X |
| 4,110,876 | 9/1978 | Weiss et al. | 181/200 X |
| 4,169,350 | 10/1979 | Yamana et al. | 57/350 |
| 4,177,629 | 12/1979 | Kennedy et al. | 57/1 R |

*Primary Examiner*—John Petrakes

*Attorney, Agent, or Firm*—Cushman, Darby & Cushman

[57] ABSTRACT

A noise control system for reducing the noise level emanating from an air jet spinning machine includes an acoustical door for covering a jet chamber which contains the air jets. The door is automatically opened whenever a yarn suction tube is to be inserted into the jet chamber for a threading-up operation.

19 Claims, 10 Drawing Figures

FIG. 3
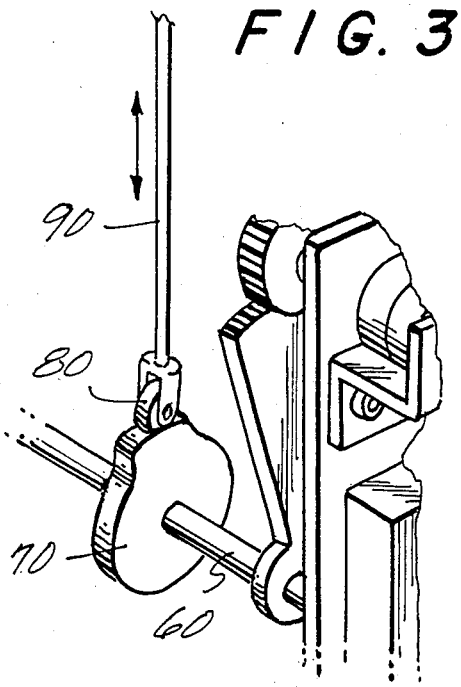
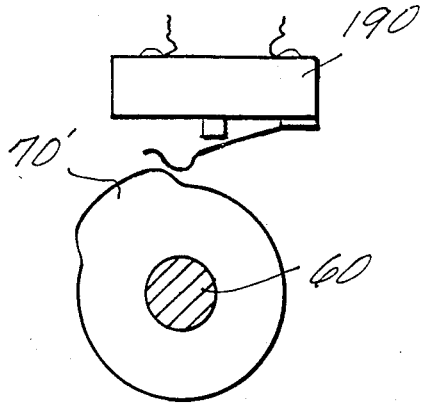
FIG. 5
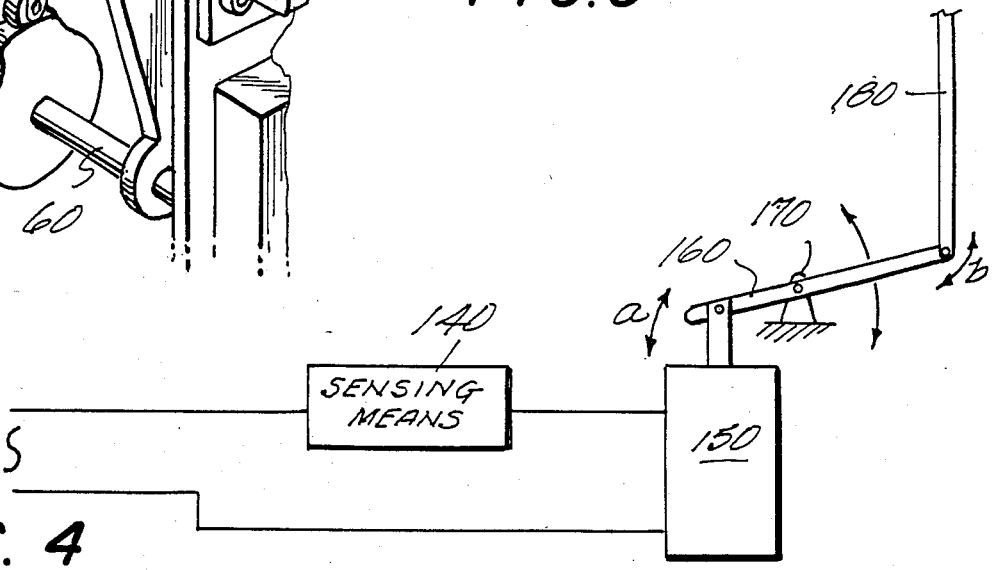
FIG. 4
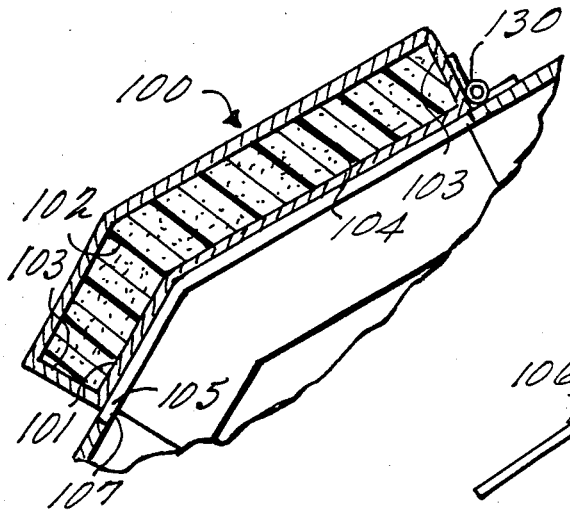
FIG. 6
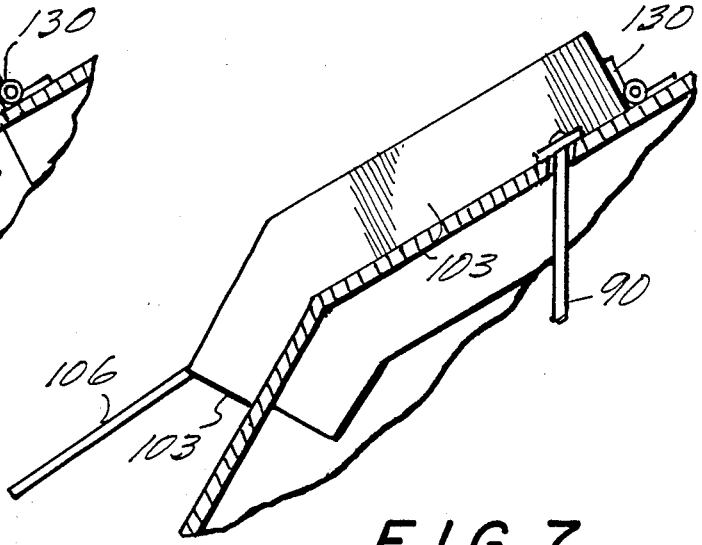
FIG. 7

FIG. 8
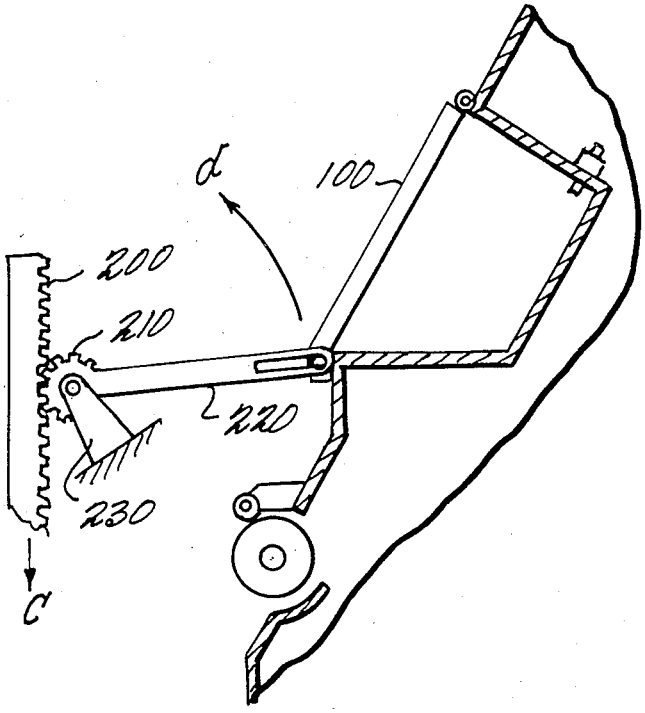
FIG. 9
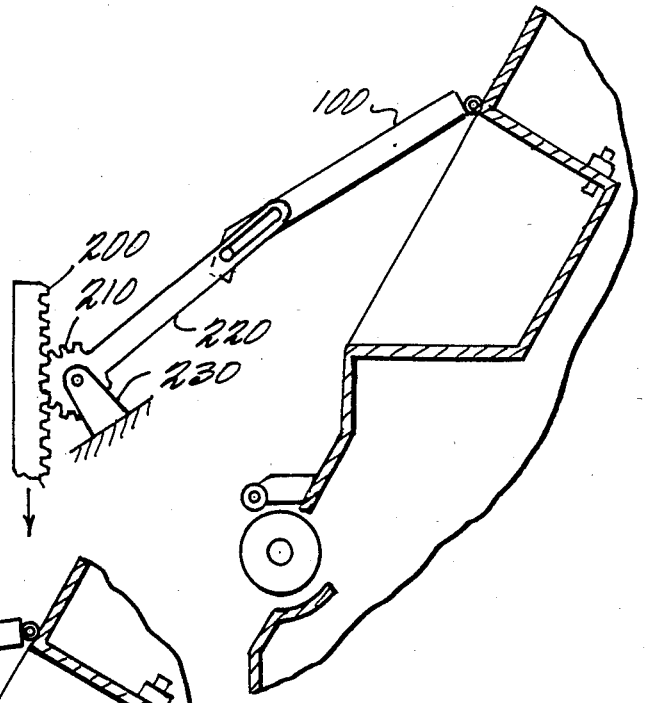
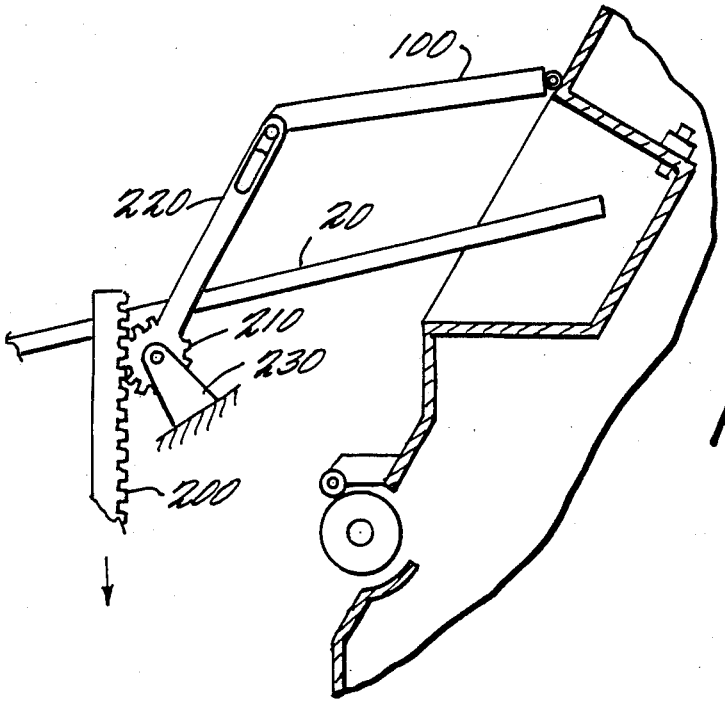
FIG. 10

NOISE CONTROL SYSTEM FOR TEXTILE MACHINERY

FIELD OF THE INVENTION

The invention relates to a noise control system for reducing the level of noise emanating from textile machinery. The invention is particularly adaptable to air jet spinning machines such as those for example manufactured by Murata or Toray.

BACKGROUND OF THE INVENTION

The jet spindle on an air jet spinning machine presents a major noise source for the machine. Such machines typically operate at 94.0–95.0 db(A) with the jet noise a major contributor to these overall levels. Accordingly, these machines often generate noise levels above employee exposure levels for 8 hours, which have been set by Federal and State legislation.

Various devices for noise abatement have been adapted for various kinds of textile machinery. These devices have a disadvantage in that they are designed to be permanently in place or must be manually opened or removed in order to provide access to the textile machinery. For example, Weiss et al, U.S. Pat. No. 4,110,876 discloses a jet muffler used in conjunction with the jet for reducing the audible noise emitted by the jet. The muffler includes a housing, sound absorbing material and a hinge means. However, in order to open the muffler an operator must manually open the housing. Similarly, Weiss et al U.S. Pat. No. 4,043,008 also discloses a noise reduction system for use with a draw point localizing jet which must be manually opened or removed in order to allow access to the jet.

The manually opened noise abatement devices of the prior art are clearly not suitable for a high production yield machine, such as for example a Murata Jet Spinner or Toray Spinning Machine, in which periodic access to the jet chamber of such a machine is required in order for a threading-up operation to take place. Access is required to the jet chamber of such machines in order to allow a yarn suction tube to enter into the jet chamber to thread-up a yarn end which has come down.

SUMMARY OF THE INVENTION

This invention provides an acoustical door for substantially covering the jet chamber of an air jet spinning machine. A small opening in the jet chamber is maintained for guiding the yarn out of the chamber. The acoustical door is hinged at one end and is automatically opened about that hinge whenever a yarn suction tube of the jet spinner machine must enter the jet chamber in order to perform a threading-up operation as determined by the traversing knotter of the machine.

In a first exemplary embodiment, the acoustical door, which has a lifting tab on one of its side surfaces, is lifted by first and second rods which abut at respective ends whenever a threading-up operation is to take place. The first rod is carried with the traversing knotter of the machine and has a cam follower which abuts against a cam, added to a rotatable shaft associated with the traversing knotter of the machine. Each of the jet chambers has an associated second rod which, as mentioned above, will abut with the first rod when the traversing knotter has been positioned adjacent that jet chamber. The shaft is rotated to a first position when the yarn suction tube is to be introduced into the jet chamber, and the shaft is rotated to a second position when the yarn suction tube is to be withdrawn from the jet chamber. Accordingly, by mounting the cam on the shaft which drives the yarn suction tube into and out of the jet chamber, the cam is able to drive the abutting first and second rods, via the cam follower, in order to open the acoustical door when the shaft has been rotated to its first position. A preferred embodiment mounts the cam on the shaft which carries the yarn suction tube.

In a modification of the above described embodiment of the invention, the cam can be mounted on the traversing knotter main shaft which drives the yarn suction tube shaft. Accordingly, whenever the yarn suction tube is to be moved into the jet chamber the cam rotating with the knotter main shaft will drive the first and second rods so as to open the acoustical door covering the jet chamber, thereby allowing the yarn suction tube to enter the jet chamber.

A major advantage of using the traversing knotter main shaft or yarn suction tube shaft to control the acoustical doors is that this arrangement requires provision of only one activating control, instead of individual jet chamber door controls, for example, on a 60 spindle machine. Thus, each spindle of the machine need only be provided with an acoustical door and a second rod, the second rod of each spindle being driven by the cam and first rod mounted on a rotatable shaft of the traversing knotter, when the knotter is positioned adjacent a spindle at which a threading-up operation is to take place.

In a second exemplary embodiment, an electromechanical, electro-magnetic or pneumatic activating device is used to operate a rod/lever system for automatically opening the acoustical door. The activating device is actuated by a sensor which determines that the yarn suction tube must enter the jet chamber for a threading-up operation. The sensor can be comprised of a micro-switch which is cam operated, a photoelectric device or the like, which is capable of sensing a required threading-up operation. The sensing devices can also comprise yarn tension sensors for sensing a break in the yarn, as one of ordinary skill in the art will readily appreciate.

Another example of a door opening mechanism is a rack and pinion arrangement in which movement of the rack during a threading-up operation rotates the pinion. An arm attached to the pinion at one end, engages with the acoustical door at its other end so that as the pinion is rotated the attached arm opens the acoustical door.

Air jet spinning machines typically include a photoelectric eye control circuit which prohibits starting of the thread-up sequence if an operator is in front of the jet spindle. Thus, even when the acoustical door is opened according to the invention, the photoelectric eye control circuit would prevent an operator from being directly exposed to the high noise levels of the jets.

Thus, the above described exemplary embodiments of the invention are capable of reducing the operating noise levels of an air jet spinner machine, while at the same time not causing an inordinate amount of down time for the machine whenever a yarn suction tube must gain access to the jet chamber.

BRIEF DESCRIPTION OF THE DRAWING

FIG. 3 shows an alternative cam location for use in the FIG. 1 exemplary embodiment;

FIG. 4 shows, in schematic form, an electro-mechanical control circuit for use in a second exemplary embodiment;

FIG. 5 shows an example of a sensing means for use in the FIG. 4 exemplary embodiment;

FIG. 6 shows a cross sectional view along line 6—6 of the acoustical door for use in the FIGS. 1 and 4 exemplary embodiments; and FIG. 7 shows a modification of the acoustical door shown in FIGS. 1 and 6;

FIGS. 8–10 show another acoustical door opening mechanism at positions ranging from the acoustical door fully closed to the acoustical door fully opened. cl

DETAILED DESCRIPTION OF EXEMPLARY EMBODIMENTS OF THE INVENTION

Figure 1:
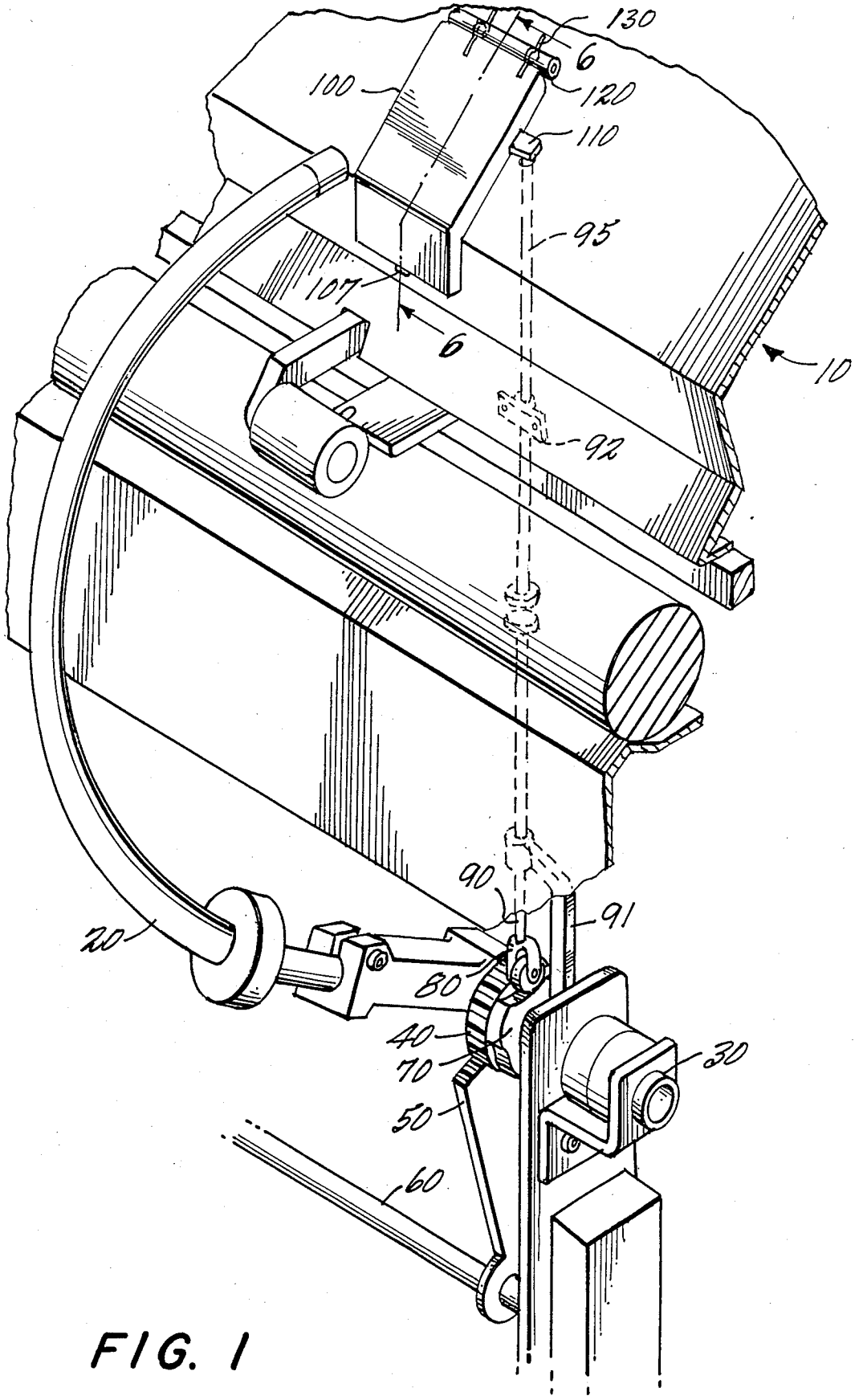
FIG. 1 shows a first exemplary embodiment of the invention, with the acoustical door of the invention in the closed position.

FIG. 1, shows a first exemplary embodiment of the invention having acoustical doors 100 fitted to substantially close each jet chamber, containing the jet nozzles, of each of the spindles of a jet spinning machine 10. Each acoustical door 100 is hinge mounted to jet spinner machine 10 by a hinge 120 and is preferably biased to the closed position by one or more tension springs 130. In the closed position the door still allows a small opening 107 for the yarn to be guided out of the jet chamber. The jet spinner machine includes a traversing knotter which determines when a particular spindle requires a threading-up operation and then moves so as to be adjacent to that spindle. The traversing knotter includes a yarn suction tube 20 mounted on a yarn suction tube shaft 30. Shaft 30 has a gear 40 mounted around its circumference which engages with a quadrant gear 50, which is fixedly mounted to a knotter main shaft 60. Shaft 30 is driven between one of two positions by knotter main shaft 60 operating through quadrant gear 50 and gear 40. A second position of shaft 30 is shown in FIG. 1, wherein yarn suction tube 20 is withdrawn from the jet chamber. The apparatus also includes a cam 70 mounted on shaft 30. A first rod 90 having a cam follower 80 at one end abuts cam 70, while first rod 90 at its other end abuts with a second rod 95 which in turn engages with a lifting tab 110 of the acoustical door 100. The first rod 90 is maintained in its proper orientation by a bracket 91 and travels with the traversing knotter. Each spindle has an associated second rod 95 which is maintained in its proper orientation by a bracket 92.

Figure 2:
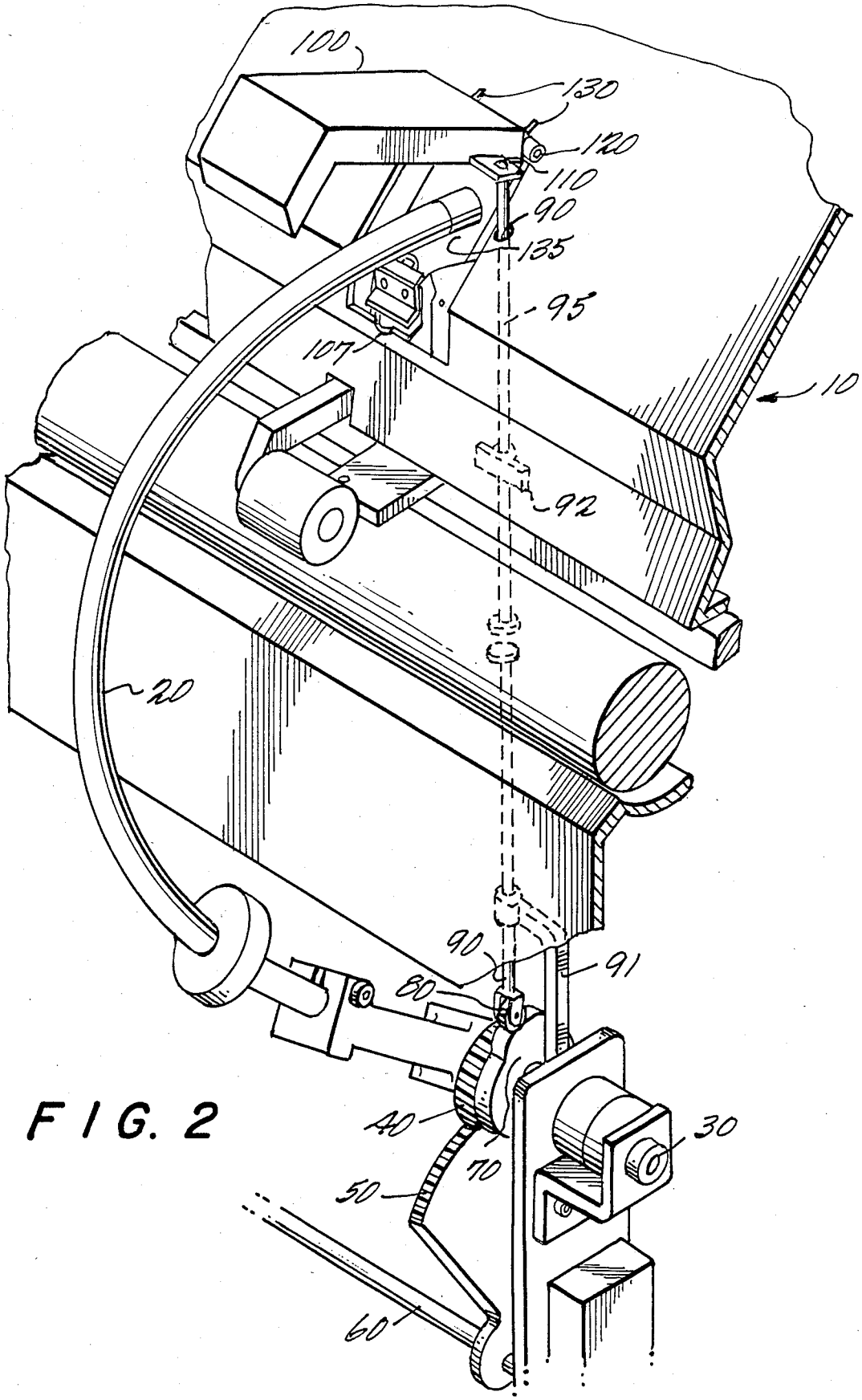
FIG. 2 shows the first exemplary embodiment of the invention, with the acoustical door of the invention in the open position.

FIG. 2 shows shaft 30 rotated to its first position wherein the cam 70 has been rotated to drive the first rod 90 and the second rod 95 upwards against the lifting tab 110, so as to open the acoustical door 100 about the hinge 120 thereby uncovering jet chamber 135. The dwell on the cam 70 is sufficient to maintain the acoustical door 100 open during the movement of the yarn suction tube 20 into the jet chamber, as shaft 30 completes its rotational movement to its first position.

In FIG. 3 a modification to the above described embodiment is shown to comprise mounting the cam 70 on the knotter main shaft 60. The first rod 90 with cam follower 80 at one end abuts against the cam 70, and when the traversing knotter is stopped adjacent a particular spindle the first rod 90 will, at its other end, abut against a second rod 95. The operation of the invention according to this modification is identical to that which has already been described with regard to the FIGS. 1 and 2 exemplary embodiment and accordingly no detailed explanation will be repeated here.

The first and second rods shown in FIGS. 1, 2 and 3 are schematic only. Depending on the spinning frame configuration, the rod may have bends or be made of segments suitably joined to go around obstructions.

A second exemplary embodiment of the present invention comprises an electro-magnetic, electro-mechanical or pneumatic activating device 150 and the control circuit for this embodiment is schematically shown in FIG. 4. A sensing means 140 which detects an ensuing threading-up operation is used to enable the activating device 150, which for example can comprise an electrical solenoid, a pneumatic operated plunger or the like. The activating device 150, which moves with the traversing knotter, is caused to contact one end of a lever 160, which pivots about a pivot point 170, when the traversing knotter is stopped adjacent a spindle. The other end of the lever engages with one end of a push rod 180 arrangement, the other end of the push rod 180 arrangement engaging the lifting tab 110 of the acoustical door 100. In operation, when the activating device 150 causes one end of the lever 160 to move downwardly as shown by arrow a in FIG. 4, the other end of the lever is caused to move upwardly as shown by arrow b in FIG. 4. The upward movement of the lever at the end which engages the push rod arrangement 180 causes the push rod to lift the lifting tab 110, thereby opening the acoustical door 100 about the hinge 120. Thus, each spindle of the machine is provided with a lever and rod arrangement which is driven by the single activating device carried by the traversing knotter. It should be noted that the push rod arrangement can comprise multiple rod segments of various shapes in order to go around obstructions.

FIG. 5 shows one example of the sensor means 140 to be comprised of a cam 70' which operates a micro-switch 190. The cam 70' can be provided on the knotter main shaft 60 or the yarn suction tube shaft 30, as has been described above with respect to the first exemplary embodiment. When the cam 70' operates the micro-switch 190 a power source (not shown) is provided to the activating device 150 in order to cause the activating device to move the lever 160, as has been described above. As will be readily appreciated by those of ordinary skill in the art other examples of sensing means 140 include any apparatus for detecting an ensuing threading-up operation. Accordingly, suitable sensing means include photoelectric systems for detecting the rotation of the knotter main shaft or the yarn suction tube shaft, yarn tension detecting sensors or the like.

FIG. 6 shows a cross sectional view of the acoustical door 100 along the line 6—6 of FIG. 1. Thus, the acoustical door can be seen to be comprised of a bottom plate 101, a top plate 102, side walls 103, insulating material 104 (contained within the cavity defined by the top and bottom plates and the side walls), and a sealing gasket 105. The sealing gasket is provided to insure a substantially soundproof cover over the jet chamber. FIG. 7 shows a modification of the acoustical door 100 to include a barrier 106 to block the line-of-sight of the yarn guide opening 107 thereby deflecting and attenuating any high frequency noise emanating from the opening.

FIGS. 8–10 show another door opening mechanism to comprise a rack 200 and a pinion 210 having an attached arm 220. The pinion is rotatably mounted on bracket 230 and arm 220 engages with acoustical door 100. In operation, when rack 200 is moved downwardly in the direction of arrow c, the pinion is rotated counterclockwise thereby swinging attached arm 220 in the direction of arrow d. The movement of attached arm 220 lifts acoustical door 100 to its opened position. FIG. 9 shows acoustical door 100 partly opened and FIG. 10 shows acoustical door 100 fully opened with yarn suction tube 20 in position for a threading-up operation. The door opening mechanism of FIGS. 8–10 can be used in any of the embodiments described above, thereby replacing the described rod and rod/lever arrangements.

It should be appreciated that the above described description of the preferred embodiments does not limit the scope of the present invention in any way, and that various changes and modifications may be made without departing from the spirit and scope of the present invention.

What is claimed is:

1. A noise control system for reducing the level of noise emanating from a jet chamber of a textile machine, said textile machine including a traversing knotter which includes a yarn suction tube which enters said jet chamber whenever a threading-up operation is required, said system comprising:

an acoustical door for substantially covering said jet chamber in order to reduce the level of noise emanating from said jet chamber;

means for detecting when a threading-up operation is required and for outputting an actuating signal;

means for opening said acoustical door; and activating means for driving said opening door means in response to said actuating signal.

2. A system as claimed in claim 1, wherein said acoustical door is mounted to said machine by a hinge and comprises:

top and bottom plates:

side walls connected to said top and bottom plates;

acoustical material provided within a cavity defined by said top and bottom plates and said side walls;

sealing means attached to the periphery of said, bottom plate for effecting a substantially soundproof covering over said jet chamber; and a means for biassing said door to its closed position.

3. A system as claimed in claim 2, wherein said acoustical door further comprises a line of-sight barrier attached to said door for deflecting and attenuating noise emanating from a yarn guide opening of said textile machine.

4. A system as claimed in claim 1, wherein said door opening means comprises:

a lever having a pivot point between first and second ends, said first end being engaged with said activating means;

a first rod engaged at one end with said second end of said lever; and a second rod engaged at one end with the other end of said first rod and the other end of said second rod being engaged with said acoustical door, wherein said activating means in response to said actuating signal causes said lever to pivot about said pivot point thereby causing said first and second rods to move upwardly thereby opening said acoustical door.

5. A system as claimed in claim 4 wherein said activating means comprises an electrical solenoid which in response to said actuating signal causes said lever to pivot about said pivot point.

6. A system as claimed in claim 4 wherein said activating means comprises a pneumatic operated plunger which in response to said actuating signal causes said level to pivot about said pivot point.

7. A system as claimed in claim 1, wherein said door opening means comprises:

a movable rack driven by said activating means; and a pinion having an attached arm, said pinion engaging with said rack and said arm engaging with said acoustical door, wherein when said activating means in response to said actuating signal causes said rack to move said pinion is rotated thereby causing said arm to open said acoustical door.

8. A noise control system for an air jet spinning machine including at least one air jet, contained within a jet chamber, and a traversing knotter having a yarn suction tube, which periodically enters the jet chamber to thread-up a yarn when a shaft of the traversing knotter is rotated to a first position, said yarn suction tube being withdrawn from the jet chamber when said shaft is rotated to a second position, said system comprising:

an acoustical door for substantially covering said jet chamber in order to reduce the level of noise emanating from said air jet spinning machine, said door being attached by a hinge to said air jet spinning machine and having a projecting lifting tab for opening said door;

a cam mounted on said rotatable shaft of said traversing knotter; and a first rod having a cam follower at one end which abuts on said cam, said first rod being carried by said traversing knotter;

a second rod engaged at one end with the other end of said first rod and the other end of said second rod being positioned for engagement with said lifting tab of said door, wherein said cam causes said first and second rods to open said door by moving said first and second rods upwardly against said lifting tab whenever said shaft is being rotated to said first position and wherein said door is maintained in a closed position whenever said shaft is rotated to said second position.

9. A system as claimed in claim 8, wherein said shaft is a yarn suction tube shaft to which the yarn suction tube is rotatably connected.

10. A system as claimed in claim 8, wherein said shaft is a knotter main shaft which drives, through a set of gears, a yarn suction tube shaft to which the yarn suction tube is rotatably connected.

11. A system as claimed in claim 8, wherein said acoustical door comprises:

top and bottom plates;

side walls connected to said top and bottom plates;

acoustical material provided within a cavity defined by said top and bottom plates and said side walls; and sealing means attached to the periphery of said bottom plate for effecting a substantially soundproof covering over said jet chamber.

12. A system as claimed in claim 11, wherein said acoustical door further comprises a line-of-sight barrier attached to said door for deflecting and attenuating noise emanating from a yarn guide opening of said air jet spinning machine.

13. A noise control system for an air jet spinning machine including at least one air jet contained within a jet chamber and a traversing knotter having a yarn suction tube, which periodically enters the jet chamber to thread-up a yarn when a shaft of the traversing knotter is rotated to a first position, said yarn suction tube being withdrawn from the jet chamber when said shaft is rotated to a second position, said system comprising:

an acoustical door for substantially covering said jet chamber in order to reduce the level of noise emanating from said air jet spinning machine, said acoustical door having a projecting lifting tab for opening said door;

door opening means for opening said door when said shaft is rotated to said first position;

sensing means for sensing when said shaft is being rotated to said first position and for outputting an actuating signal in response thereto; and activating means for driving said door opening means to open said door in response to said actuating signal from said sensing means.

14. A system as claimed in claim 13, wherein said door opening means comprises:

a lever having a pivot point between first and second ends, said first end being engaged with said activating means; and a first rod engaged at one end with said second end of said lever; and a second rod engaged at one end with the other end of said first rod and the other end of said second rod being engaged with said lifting tab, wherein said activating means in response to said actuating signal causes said lever to pivot about said pivot point thereby causing said first and second rods to move said lifting tab thereby opening said door.

15. A system as claimed in claim 14, wherein said activating means comprises an electrical solenoid which in response to said actuating signal causes said lever to pivot about said pivot point.

16. A system as claimed in claim 14, wherein said activating means comprises a pneumatic operated plunger which in response to said actuating signal causes said lever to pivot about said pivot point.

17. A system as claimed in claim 14, wherein said acoustical door comprises:

top and bottom plates;

side walls connected to said top and bottom plates;

acoustical material provided within a cavity defined by said top and bottom plates and said side walls; and sealing means attached to the periphery of said bottom plate for effecting a substantially soundproof covering over said jet chamber.

18. A system as claimed in claim 17, wherein said acoustical door further comprises a line-of-sight barrier attached to said door for deflecting and attenuating noise emanating from a yarn guide opening of said air jet spinning machine.

19. A system as claimed in claim 13, wherein said sensing means comprises:

a cam mounted on said rotatable shaft; and a micro-switch being operated by said cam when said shaft is rotated to said first position, said micro-switch providing said actuating signal to said actuating means in response to operation by said cam.

* * * * *